US005233390A

United States Patent [19]

Fujimoto

[11] Patent Number: 5,233,390

[45] Date of Patent: Aug. 3, 1993

[54] ELECTRONIC PRINTER DEVELOPING UNIT WITH BRACKET FOR POSITIONING MAGNETIC ROLLER AND DOCTOR BLADE

[75] Inventor: Tetsuya Fujimoto, Kawasaki, Japan

[73] Assignee: Fujitsu Limited, Kawasaki, Japan

[21] Appl. No.: 854,584

[22] Filed: Mar. 20, 1992

[30] Foreign Application Priority Data

Mar. 29, 1991 [JP] Japan ..... 3-065134

[51] Int. Cl.[5] ..... G03G 15/08

[52] U.S. Cl. ..... 355/245; 355/251; 118/653

[58] Field of Search ..... 355/245, 251, 253; 118/653, 657, 658

[56] References Cited

FOREIGN PATENT DOCUMENTS

| | | | |
|---|---|---|---|
| 4003974 | 8/1990 | Fed. Rep. of Germany . | |
| 4112053 | 10/1991 | Fed. Rep. of Germany . | |
| 60-78467 | 5/1985 | Japan | 355/245 |
| 3-148677 | 6/1991 | Japan | 355/245 |
| 2051614 | 1/1981 | United Kingdom . | |

OTHER PUBLICATIONS

*Patent Abstracts of Japan*, vol. 7, No. 146 (P-206) (1291), Jun. 25, 1983 (JP 58-057152).

*Patent Abstracts of Japan*, vol. 6, No. 92 (P-119) (970), May 29, 1982 (JP 57-026880).

"Magnetic Brush Developer", *IBM Technical Disclosure Bulletin*, vol. 31, No. 12, May, 1989, pp. 467 and 468, New York, USA.

*Primary Examiner*—Joan H. Pendegrass

*Attorney, Agent, or Firm*—Staas & Halsey

[57] ABSTRACT

A bracket having great rigidity is provided. A magnetic roller is rotatably mounted on the bracket and a doctor blade is fixed to the bracket. A bracket assembly comprising the bracket, the magnetic roller and the doctor blade is fixed to a frame of a developing unit. A gap g between the magnetic roller and the doctor blade is maintained at a predetermined value even if the frame is deformed due to an external force, and thus printing at a constant density is ensured.

7 Claims, 5 Drawing Sheets

ELECTRONIC PRINTER DEVELOPING UNIT WITH BRACKET FOR POSITIONING MAGNETIC ROLLER AND DOCTOR BLADE

BACKGROUND OF THE INVENTION

1. Field of the Invention

The present invention relates to a developing unit for use in an electronic printing apparatus. More particularly, the present invention relates to a developing unit which is capable of easily adjusting a gap between a doctor blade and magnetic roller and stably maintaining this gap.

2. Description of the Related Art

In an electronic photographic printer or electronic copying machine, an electrostatic latent image corresponding to an image to be printed or copied is optically formed on a photosensitive drum. Thereafter, the electrostatic latent image is developed using powdered toner and the image produced by the toner is transferred to recording paper and fixed. Thus, a desired image is printed or copied. FIG. 1 is a schematic view illustrating the construction of such an electronic photographic printer. The electronic photographic printer comprises a photosensitive drum 1 having a cylindrical surface on which electrostatic latent images are formed by projecting optical images; a cleaner 2 for cleaning the cylindrical surface of the photosensitive drum 1; a charging unit 3 for uniformly charging the cylindrical surface of the photosensitive drum 1 by ultraviolet-ray irradiation or the like; and a scanning unit 4 for scanning the cylindrical surface of the photosensitive drum 1 with a light beam RB from a laser diode (not shown) or the like. The scanning unit 4 comprises a polygonal mirror **4*a* for causing the light beam RB to deflect in the axial direction of the photosensitive drum 1; a focal quality fg lens 4*b* for compensating for a focal distance; a mirror 4*c* for deflecting light beam RB; and a cylindrical lens 4*d* for making the light beam RB converge on the cylindrical surface of drum 1**.

When the light beam RB is turned on/off on the basis of image data while the photosensitive drum 1 is being rotated and the cylindrical surface of the photosensitive drum 1 is being scanned with the light beam RB, an electrostatic latent image is formed on the cylindrical surface of the photosensitive drum 1.

In FIG. 1, reference numeral 5 denotes a developing unit for developing the electrostatic latent image by toner; reference numeral 6 denotes a transfer unit for transferring the image formed by toner, transferred onto the cylindrical surface of the photosensitive drum 1, to recording paper; reference numeral 7 denotes a discharging unit for removing charges remaining on the recording paper; reference numeral 8 denotes a fixing unit for fixing toner to recording paper; and reference numeral 9 denotes a hopper for recording paper, for example, two hoppers **9*a* and 9*b* for supplying sheets of paper of different sizes are provided; reference numeral 10 denotes a guide for feeding recording paper; reference numeral 11 denotes a stacker for recording paper; and reference numeral 12** denotes a top lid.

As shown in FIG. 2, the developing unit 5 comprises a container 51 which is filled with powdered toner TN and a frame 52 for holding the container. The container 51 is generally divided into a stirring section **5*a* for causing frictional electrification of the particles of toner TN by stirring the toner, and a toner-separation section 5*b*. A sensor 5*c* for detecting the amount of the toner TN remaining inside the container 51** is disposed in the vicinity of the bottom thereof.

The toner TN is stirred as a result of a stirring member 5a-1 being rotated. The granular toner TN is electrified by the friction between the toner TN and the stirring member 5a-1, and sent to the toner-separation section **5*b*. The electrified toner TN adheres by a magnetic force to a magnetic roller 5b-1 in the toner-separation section 5*b*. In this way, the toner particles adhere to the cylindrical surface of the magnetic roller 5b-1 in a layered form. After the thickness of the toner particles TN, i.e., the height from the cylindrical surface, is restricted by a doctor blade 5b-2 placed in proximity to the cylindrical surface of the magnetic roller 5b-1, the toner particles contact the cylindrical surface of the photosensitive drum 1. As a result, the toner TN moves from the magnetic roller 5b-1 to the photosensitive drum 1. However, the amount of the toner TN moved varies in proportion to the magnitude of the difference between a bias voltage applied to the magnetic roller 5b-1 and the electrical potential resulting from the electrostatic latent image on the cylindrical surface of the photosensitive drum 1**. Only those electrostatic latent images in which the difference between the bias voltage and the electrical potential is larger than a threshold value are developed by the toner TN.

In the conventional developing unit 5, both the magnetic roller 5b-1 and the doctor blade 5b-2 are directly fixed to the frame 52. As a lighter weight electronic photographic printer or electronic copying machine is demanded, the frame 51 is usually formed from plastic materials. As a consequence, the rigidity thereof is slight, and therefore distortion is likely to occur when an external force is applied thereto. When, for example, a printer is placed on a base which is not flat, the entire chassis and casing of the printer is deformed due to the weight of the printer, say, 30–50 kg, causing the frame 52 of the developing unit 5 to be distorted. The gap between the magnetic roller 5b-1 and the doctor blade 5b-2 is as narrow as 0.26 to 0.28 mm, and is easily caused to vary due to such distortion of the developing unit 5 as that described above. Therefore the height of the toner TN on the cylindrical surface of the magnetic roller 5b-1 is no longer maintained at a constant. A problem arises in that the amount of the toner TN transferred to the cylindrical surface of the photosensitive drum 1 changes with not only the potential difference between the magnetic roller 5b-1 and the drum 1 but also with the change of the gap. When the gap is not uniform, the density of the image on the recording paper is not uniform. Also, variations in the gap are sometimes caused by vibrations from outside. If such problems occur, complicated and complex adjustments and maintenance of electronic photographic printers or electronic copying machines must be performed.

SUMMARY OF THE INVENTION

Accordingly, an object of the present invention is to provide a construction which is capable of maintaining the gap between a magnetic roller and a doctor blade at a constant distance even when the frame of a developing unit is distorted due to an external force.

Another object of the present invention is to provide a developing unit which is capable of printing at a uniform density without substantially increasing the weight of an electronic photographic printer or electronic copying machine.

A further object of the present invention is to provide a developing unit in which printing density does not change due to outside vibrations.

A still further object of the present invention is to provide a developing unit which is capable of easily adjusting and maintaining the printing density.

The aforementioned and other objects, features and advantages of the present invention will become clear when reference is made to the following description of the preferred embodiments of the present invention, together with reference to the accompanying drawings.

BRIEF DESCRIPTION OF THE DRAWINGS

FIG. 6(*b*) is a perspective view illustrating a state in which the bracket assembly is assembled; and FIG.

DESCRIPTION OF THE PREFERRED EMBODIMENT

Figure 3:
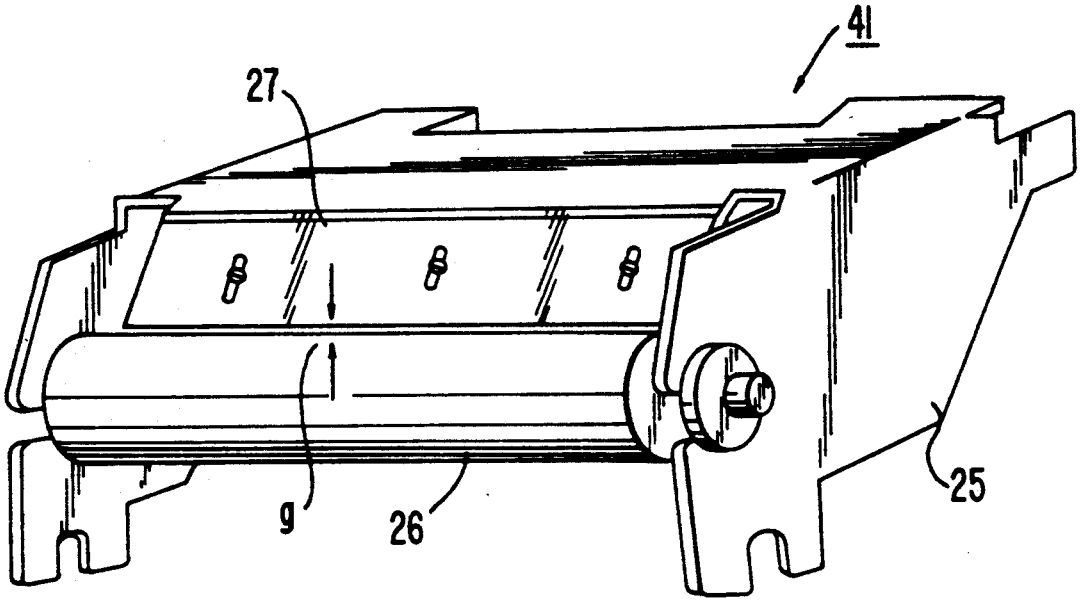
FIG. 3 is a perspective view which illustrates the fundamental construction of the present invention.

FIG. 3 is a perspective view which illustrates the fundamental construction of a bracket assembly 41 of the present invention. In the present invention, a bracket 25 produced by punching and bending sheet metal is provided, and a magnetic roller 26 and a doctor blade 27 are held by the bracket 25. The magnetic roller 26 is rotatably supported by the bracket 25, and the doctor blade 27 is fixed to the bracket 25. In this way, the magnetic roller 26 and the doctor blade 27 are mounted onto the frame (not shown) of the developing unit by means of the bracket 25. Since the bracket 25 is very rigid because it is made of a metallic plate and because the magnetic roller 26 and the doctor blade 27 are not directly fixed to the frame of the developing unit, even if the developing unit is distorted because the printer casing is deformed, there is no variation in the relative positions of the magnetic roller 26 and the doctor blade 27. As a result, the gap g between the magnetic roller 26 and the doctor blade 27 can be maintained at a constant, and the printing density is uniform and stable.

Figure 1:
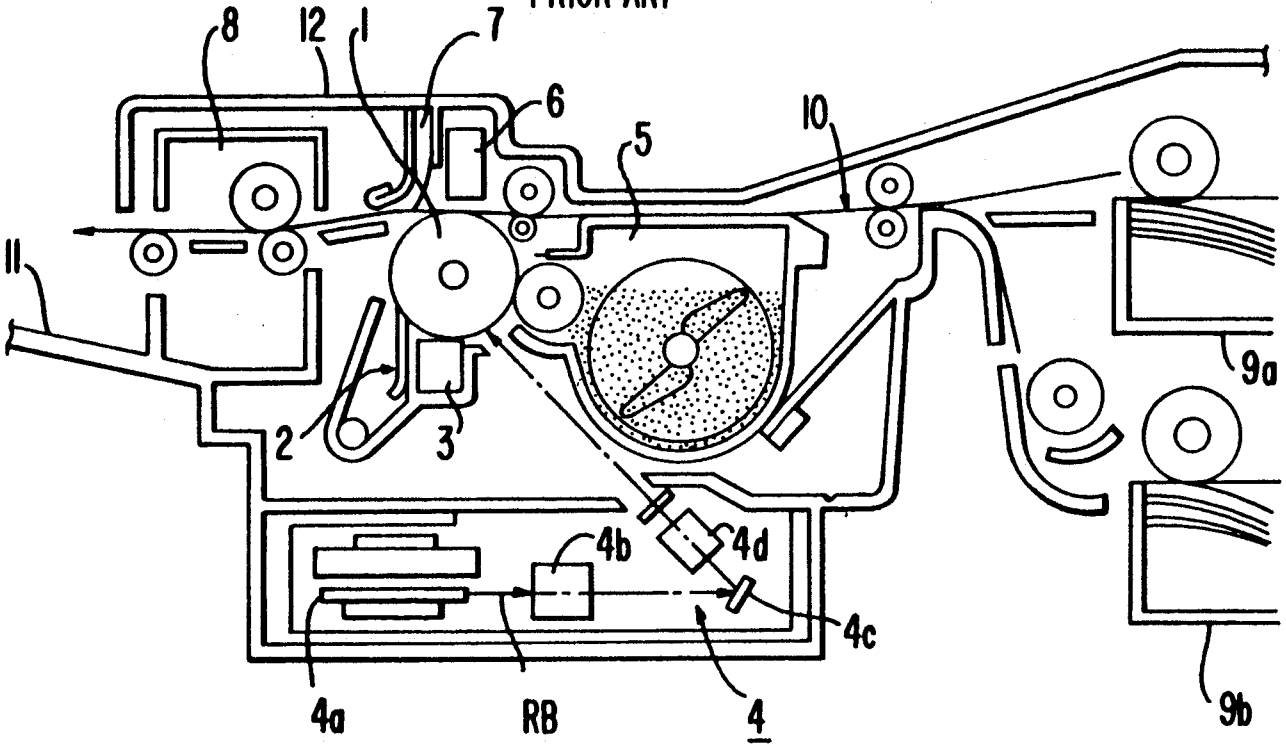
FIG. 1 PRIOR ART
FIG. 1 is a schematic view which illustrates the construction of an electronic photographic printer which may incorporate the present invention.
Figure 2:
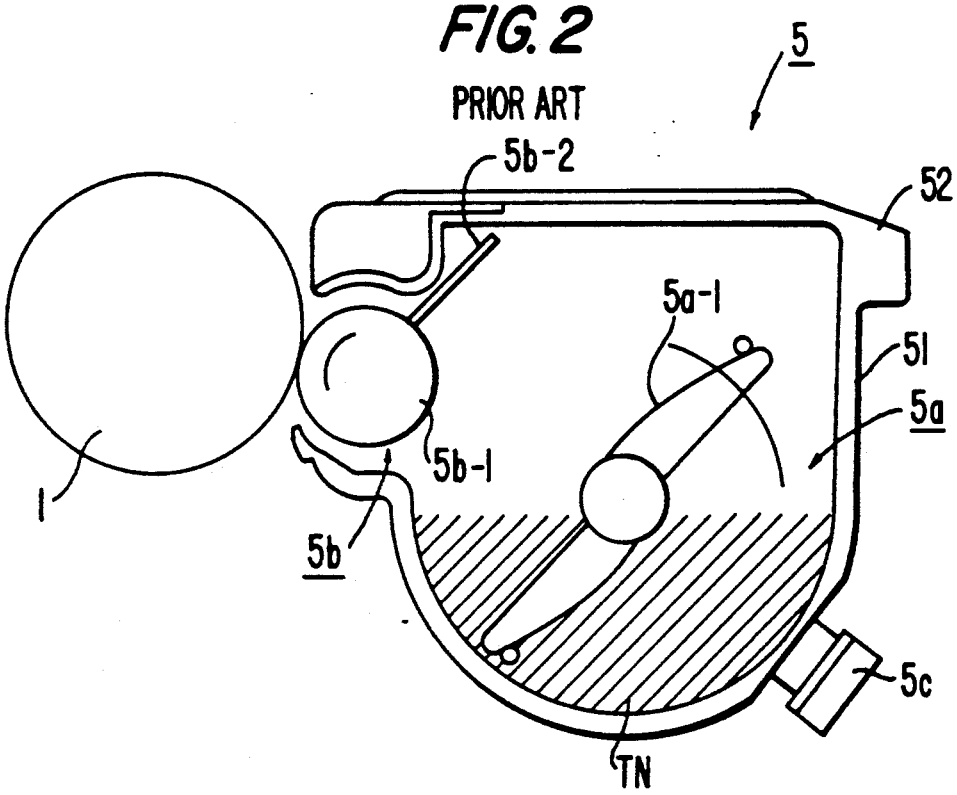
FIG. 2 PRIOR ART
FIG. 2 is a view which illustrates the construction of a conventional developing unit of an electronic photographic printer.
Figure 4:
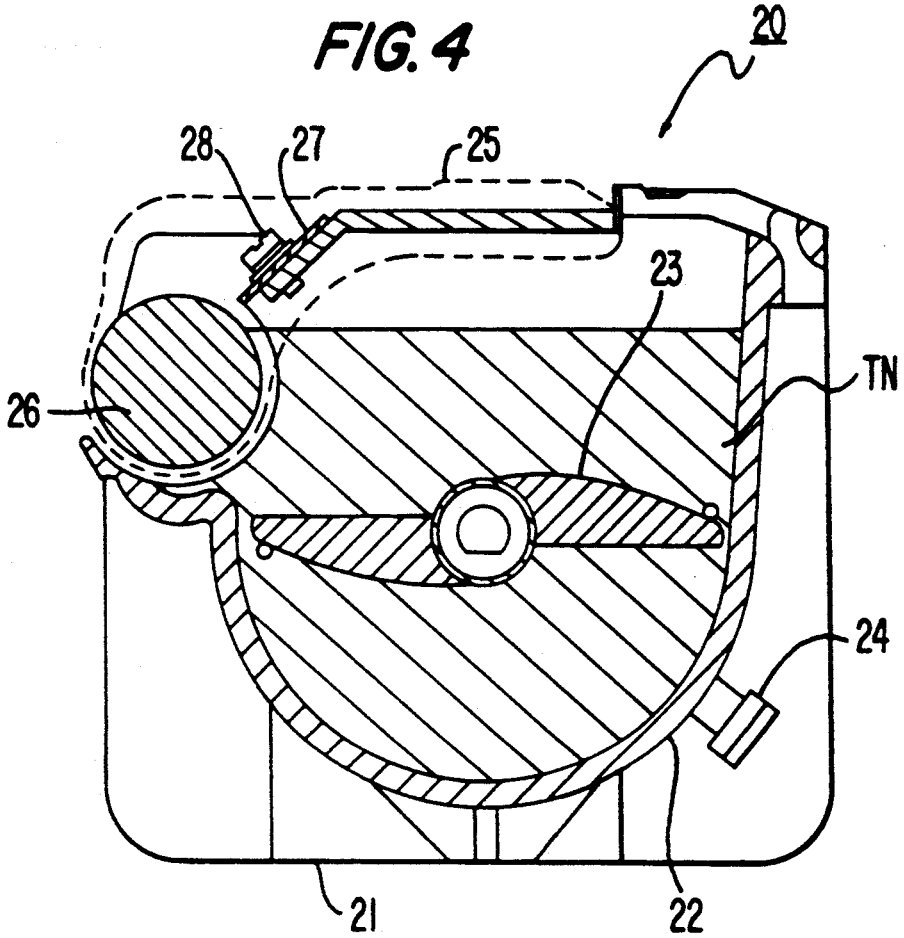
FIG. 4 is a cross-sectional view which illustrates the construction of a developing unit of the present invention.

FIG. 4 is a cross-sectional view which illustrates the construction of a developing unit 20 of the present invention. It comprises a container 22 filled with powdered toner TN and a frame 21 for supporting the container in the same manner as in the conventional developing unit which was explained referring to FIG. 2. A stirring member 23 for stirring the toner TN to cause frictional electrification is disposed inside the container 22. A toner sensor 24 for detecting the amount of toner TN remaining inside the container 22 is disposed in the vicinity of the bottom of the container 22. The electrified toner TN is deposited on a magnetic roller 26 and is transported to a photosensitive drum (not shown).

In the developing unit 20 of the present invention, the magnetic roller 26 and the doctor blade 27 employed for restricting the height of the toner TN deposited on the cylindrical surface of the magentic roller 26 are held by the bracket, 25 which is fixed to the frame 21 in a manner described later. Reference numeral 28 denotes screws for fixing the doctor blade 27 to the bracket 25. The bracket 25 is produced by punching and then bending a sheet plate, as described above. As a consequence, the bracket 25 is very rigid and therefore is not deformed even if a relatively large force is applied to it.

Figure 5:
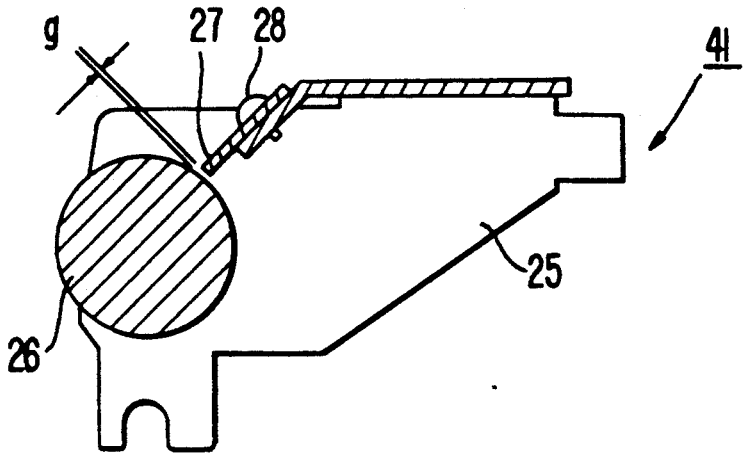
FIG. 5 is a cross-sectional view of a bracket assembly of the developing unit of the present invention.

FIG. 5 is a cross-sectional view of a bracket assembly 41 with the magnetic roller 26 and the doctor blade 27 mounted on the bracket 25. The rotational shaft 26*b* (FIG. 6(*a*)) of the magnetic roller 26 is supported by a bearing (not shown) provided on the bracket 25. After the position of the doctor blade 27 is adjusted so that the gap g between: the doctor blade 27 and the magnetic roller 26 is set at a predetermined value, the doctor blade 27 is fixed to the bracket 25 by the screws 28.

Figure 6A:
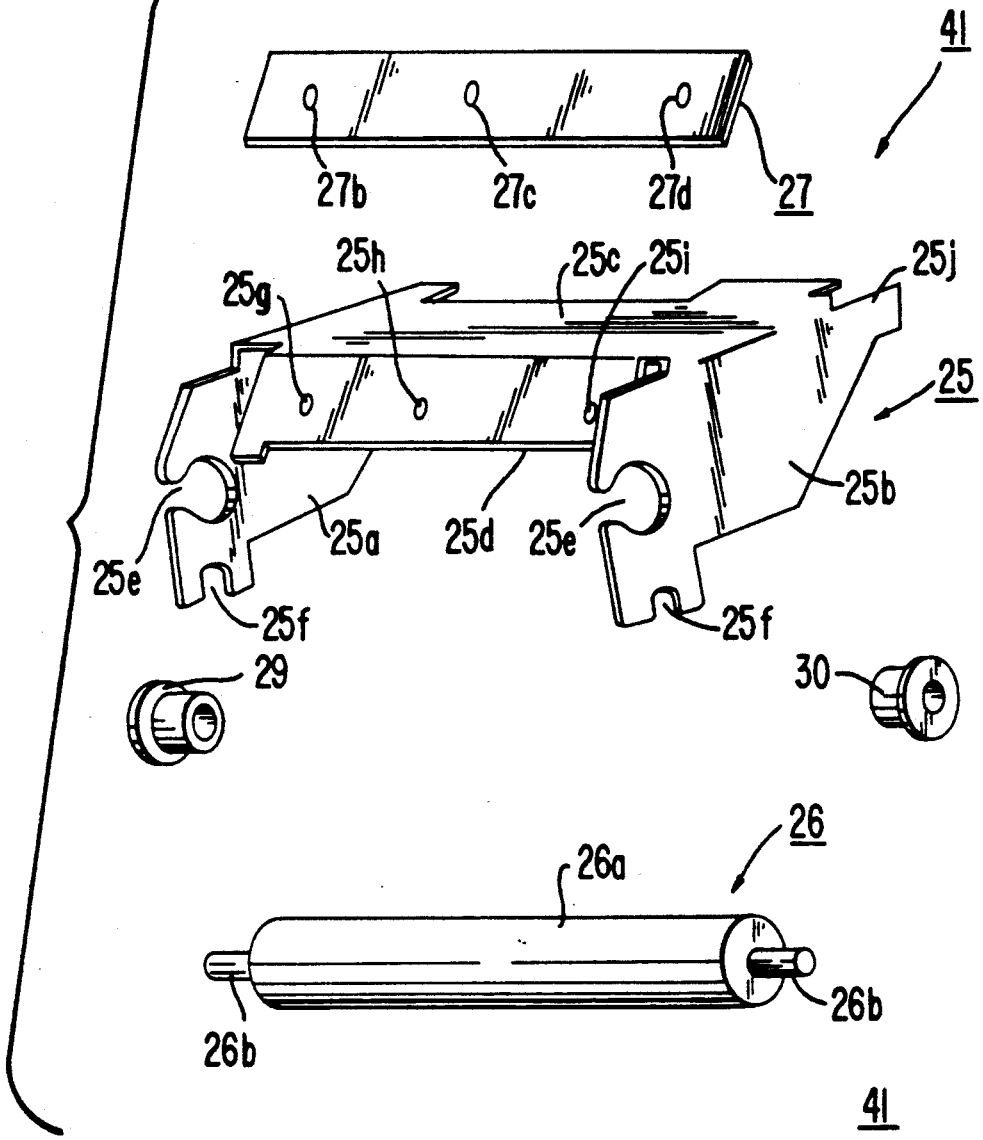
FIG. 6(*a*) is an exploded perspective view of the bracket assembly of the developing unit of the present invention.
Figure 6B:
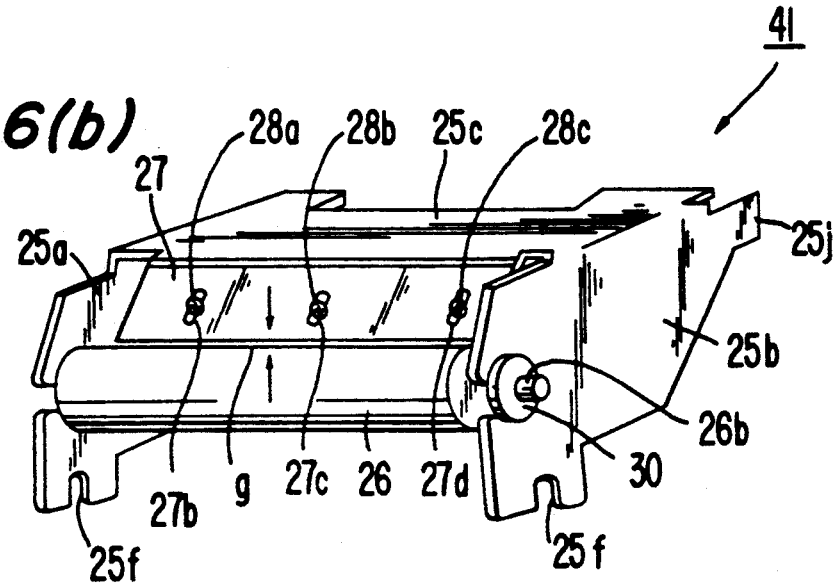

FIG. 6(*a*) is an exploded perspective view which illustrates the construction of the bracket assembly 41 in detail. FIG. 6(*b*) is a perspective view illustrating the assembled bracket assembly. Referring to FIG. 6(*a*), the bracket 25 is produced by punching a sheet plate into a predetermined form and then bending it, as described above. The bracket 25 has side plate sections 25*a* and 25*b*, a top plate section 25*c* and a doctor blade mounting section 25*d* which extends obliquely from the top plate section 25*c*. A circular cutout 25*e*, a semicircular cutout 25*f* and a projecting portion 25*j* are provided on each of the two side plate sections 25*a* and 25*b*. The circular cutouts 25*e* rotatably hold the magnetic roller 26. The semicircular cutouts 25*f*, fitted to pins disposed on a development frame (both not shown) for holding the assembly 41, to the development frame. The projecting portions 25*j* are provided for positioning the bracket assembly 41 with respect to the frame 21 Tapped holes 25*g*, 25*h* and 25*i* are provided is the doctor blade mounting section 25*d* for receiving screws to fix the blade 27 to the panel section 25*d*.

The magnetic roller 26 has a cylindrical main body portion 26*a*, and a shaft 26*b* which is fixed to the main body portion 26*a* and extends from both ends thereof. The doctor blade 27 has a rectangular shape, in which slits 27*b*, 27*c* and 27*d* extending through the doctor blade 27 are provided. The slits 27*b*, 27*c* and 27*d* are positioned in such a manner as to correspond to the tapped holes 25*g*, 25*h* and 25*i*.

When assembling, as shown in FIG. 6(*b*), the shaft 26*b* of the magnetic roller 26 is fitted to the circular cutouts 25*e* of the bracket 25 via the bearings 29 and 30. After the magnetic roller 26 is rotatably mounted on the bracket 25 in this manner, the doctor blade 27 is disposed on the doctor blade mounting section 25*d* and is tentatively fixed by screws 28*a*, 28*b* and 28*c*. The position of the doctor blade 27 is adjusted to set the gap g between it and the magnetic roller 26 at a predetermined value. Then the position is fixed by tightening the screws 28*a*, 28*b* and 28*c*. Thus, the bracket assembly 41 is completed.

Figure 7A:
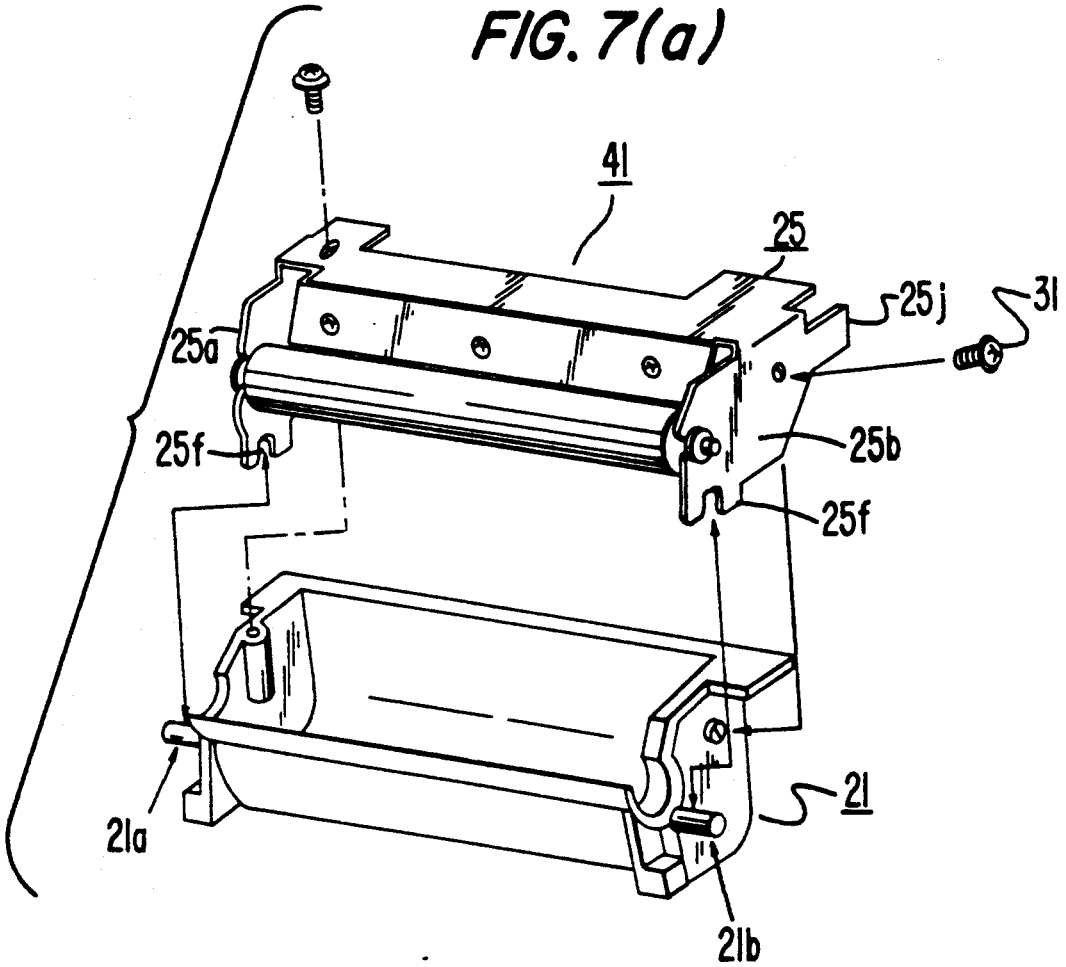
FIGS. 7(*a*) and 7(*b*) are perspective views of the structure of the invention, as exploded and assembled respectively, which illustrate a method of linking the frame of the developing unit to the bracket assembly according to the present invention.
Figure 7B:
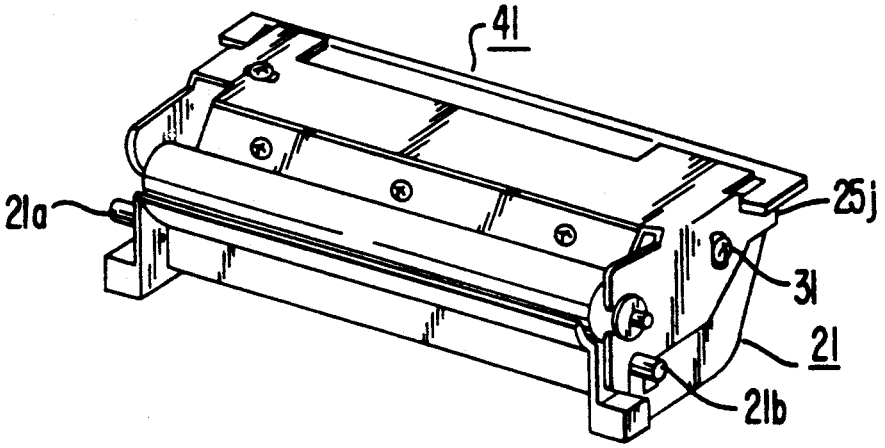

FIGS. 7(*a*) and 7(*b*) are an exploded perspective view and a perspective view, respectively, which illustrate an example of one method of linking the frame 21 of the developing unit 20 to the bracket assembly 41. The semicircular cutouts 25*f* provided in both the side plate sections 25*a* and 25*b* of the bracket 25 are fitted to a pair of pins 21*a* and 21*b* provided on the frame 21. The bracket assembly 41 is connected to the frame 21 by a screw 31 in such a way that the projecting portions 25*j* provided on the side plate sections 25*a* and 25*b* are brought into abutment with the frame 21. In this way, the frame 21 and the bracket assembly 41 are fixed to each other. Alternative methods may be used for linking the frame 21 to the bracket assembly 41, such as a hooking structure employing claws.

According to the present invention, as has been explained above, a bracket having great rigidity for holding a magnetic roller and a doctor blade is provided, and the magnetic roller and the doctor blade are fixed to a frame of a developing unit by means of the bracket. Therefore, even if a large external force is applied to the frames of an electronic photographic printer or a developing unit thereof, no change occurs in the gap between the magnetic roller and the doctor blade. As a consequence, the printer can maintain a constant printing density without being affected by the installation process or environmental vibrations. Furthermore, since the gap can be adjusted at the bracket assembly stage, density adjustment and maintenance operations can be performed easily and efficiently. In addition, according to the present invention, since the bracket assembly is manufactured and maintained as a unitary structure, improved quality, stability and a reduced cost of the printer are achieved. An increase in the weight due to the addition of a bracket is 0.5 kg or less, which is negligible considering the weight of the entire printer.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded a broad interpretation, so as to encompass all such modifications and equivalent structures and functions.

What is claimed is:

1. A developing unit for use in an electronic printing apparatus having a photosensitive drum on which electrostatically charged toner particles are deposited, comprising:

a source of electrically charged toner particles and a frame, mounted within the electronic printing apparatus, for supporting a supply of the electrically charged toner particles within the electronic printing apparatus;

a magnetic roller having opposite mounting ends and a circumferential surface on which electrically charged toner particles adhere, the magnetic roller having a rotational drive shaft, including a pair of opposite mounting ends extending axially beyond the corresponding, opposite ends of the circumferential surface, for rotating the magnetic roller;

a doctor blade; and a rigid bracket which is removably mountable on and thereby supported by the frame and which comprises a top plate portion, a pair of spaced, side plate portions integrally connected to and depending from respective opposite and spaced side edges of the top plate and a doctor blade mounting portion integrally connected to and depending downwardly from a lateral edge of the top plate portion, the doctor blade and the lateral edge extending transversely to the pair of spaced, parallel side edges of the top plate, the pair of opposite mounting ends of the rotational drive shaft being received in and supported by the pair of spaced, side plate portions, respectively, and the doctor blade being selectively positioned and mounted on the doctor blade mounting portion and thereby spaced by a gap of a selectively adjustable size from the circumferential surface of the magnetic roller, the rigid bracket, when received on and supported by the frame, disposing the magnetic roller in association with the source of electrically charged toner particles whereby the electrically charged toner particles are received on and adhere to the circumferential surface of the magnetic roller, the doctor blade restricting the height of the toner particles adhered on the circumferential surface of the magnetic roller in correspondence with the size of the gap, and the magnetic roller being driven in rotation for transporting the electrically charged toner particles adhered on the circumferential surface thereof to, and for deposit on, the photosensitive drum.

2. The developing unit as recited in claim 1, further comprising:

a pair of bearings, each of circular cross-section, and a corresponding pair of circular cutouts in the pair of side plate portions, respectively, of the rigid bracket, the opposite mounting ends of the rotational shaft of the magnetic roller being received in the respective bearings and the bearings being received in the respective circular cutouts and thereby supporting the magnetic roller in the respective side plate portions of the rigid bracket.

3. A developing unit for use in an electronic printing apparatus having a photosensitive drum on which electrostatically charged toner particles are deposited, comprising:

a source of electrically charged toner particles and a frame, mounted within the electronic printing apparatus, for supporting a supply of the electrically charged toner particles within the electronic printing apparatus;

a magnetic roller having opposite mounting ends and a circumferential surface on which electrically charged toner particles adhere, the magnetic roller having a rotational drive shaft, including a pair of opposite mounting ends extending axially beyond the corresponding, opposite ends of the circumferential surface, for rotating the magnetic roller;

a doctor blade;

a rigid bracket which is removably mountable on and thereby supported by the frame and which comprises a top plate portion, a pair of spaced, side plate portions connected to and depending from respective opposite and spaced side edges of the top plate and a doctor blade mounting portion connected to and depending downwardly from a lateral edge of the top plate portion, the doctor blade and the lateral edge extending transversely to the pair of spaced, parallel side edges of the top plate, the pair of opposite mounting ends of the rotational drive shaft being received in and supported by the pair of spaced, side plate portions, respectively, and the doctor blade being selectively positioned and mounted on the doctor blade mounting portion and thereby spaced by a gap of a selectively adjustable size from the circumferential surface of the magnetic roller, the rigid bracket, when received on and supported by the frame, disposing the magnetic roller in association with the source of electrically charged toner particles whereby the electrically charged toner particles are received on and adhere to the circumferential surface of the magnetic roller, the doctor blade restricting the height of the toner particles adhered on the circumferential surface of the magnetic roller in correspondence with the size of the gap, and the magnetic roller being driven in rotation for transporting the electrically charged tone particles adhered on the circumferential thereof to, and for deposit on, the photosensitive drum;

the frame further comprising:

a pair of mounting pins projecting outwardly from the respective, spaced pair of side plate portions of the rigid bracket; and the pair of side plate portions of the rigid bracket respectively including lower edges having corresponding cutout portions therein which are received in mating relationship on the respective pair of mounting pins when the rigid bracket is mounted on the frame thereby for supporting the rigid bracket on the frame.

4. The developing unit as recited in claim 3, further comprising:

a pair of bearings, each of circular cross-section, and a corresponding pair of circular cutouts in the pair of side plate portions, respectively, of the rigid bracket, the opposite mounting ends of the rotational shaft of the magnetic roller being received in the respective bearings and the bearings being received in the respective circular cutouts and thereby supporting the magnetic roller in the respective side plate portions of the rigid bracket.

5. A developing unit of an electronic printing apparatus having a photosensitive drum, comprising:

a frame and container assembly, the container being supported by and depending from the frame and having spaced and interconnected end, side and bottom walls defining an interior volumetric space for receiving toner particles, to be transported from the container to a photosensitive drum of the electronic printing apparatus, the upper edges of the side and end walls being affixed to corresponding frame elements and depending therefrom;

a magnetic roller having opposite mounting ends and a circumferential surface on which electrically charged toner particles adhere;

a doctor blade; and a rigid bracket which is removably mountable on the frame and container assembly, the rigid bracket having affixed thereon a pair of spaced, rotatable mounts which receive and rotatably mount therein the respective opposite ends of the magnetic roller, the rotatable mounts being affixed to the rigid bracket at corresponding positions whereby the magnetic roller is disposed within the container when the bracket is mounted on the frame and container assembly and collects the electrically charged toner particles on the circumferential surface thereof, the magnetic roller being driven in rotation for transporting the electrically charged toner particles adhered on the circumferential surface thereof from within the container to the photosensitive drum, the bracket further having a mounting plate on which the doctor blade is rigidly mounted at a selectively adjustable position relatively to the circumferential surface of the magnetic roller so as to define a gap of a predetermined size therebetween and thereby to restrict the height of the toner particles adhered on the circumferential surface of the magnetic roller in correspondence with the size of the gap.

6. A developing unit as recited in claim 5, wherein the bracket further comprises:

a pair of side plate portions, spaced by approximately the same distance as and so as to be receivable between the corresponding side walls of the container, and to which the pair of rotatable mounts are respectively affixed, for rotatably supporting the magnetic roller within the interior of the container when the bracket is mounted on the frame and container assembly;

a top plate portion extending between and rigidly interconnecting the pair of side plate portions;

a mounting plate rigidly connected to the top plate portion; and means for rigidly mounting the doctor blade to the mounting plate at a selected position thereon in accordance with the selected gap size.

7. A developing unit as recited in claim 6, wherein:

the frame and container assembly further comprises a pair of mounting pins disposed at corresponding positions on, and projecting outwardly from the respective side walls and rigidly interconnected with the corresponding frame elements; and the side plate portions of the bracket include respective cutout portions in the lower edges thereof which receive, in mating relationship, the corresponding mounting pins when the bracket is mounted on the frame.

* * * * *

UNITED STATES PATENT AND TRADEMARK OFFICE

CERTIFICATE OF CORRECTION

PATENT NO. : 5,233,390

DATED : August 3, 1993

INVENTOR(S) : Tetsuya FUJIMOTO

It is certified that error appears in the above-indentified patent and that said Letters Patent is hereby corrected as shown below:

Column 4, line 39, insert --are-- after "25f,";
line 43, insert --(Fig. 4).-- after "21"

Signed and Sealed this

Third Day of May, 1994

Bruce Lehman

*Attest:*

BRUCE LEHMAN

*Attesting Officer*

*Commissioner of Patents and Trademarks*